US005218747A

United States Patent [19]

Riedel

[11] Patent Number: 5,218,747

[45] Date of Patent: Jun. 15, 1993

[54] METHOD OF AND ARRANGEMENT FOR GRINDING OR POLISHING WEB-SHAPED TEXTILE STRUCTURES

[75] Inventor: Dieter Riedel, Porta Westfalica, Fed. Rep. of Germany

[73] Assignee: Johannes Menschner Maschinenfabrik GmbH & Co. KG., Viersen, Fed. Rep. of Germany

[21] Appl. No.: 808,027

[22] Filed: Dec. 13, 1991

[30] Foreign Application Priority Data

Mar. 28, 1991 [DE] Fed. Rep. of Germany ..... 4110232

[51] Int. Cl.[5] ..... D06C 11/00

[52] U.S. Cl. ..... 26/28

[58] Field of Search ..... 26/27, 28, 51.4, 77, 26/70, 74; 51/165 R, 165.75, 165.87, 165.71, 334, 400, 401

[56] References Cited

U.S. PATENT DOCUMENTS

| | | | |
|---|---|---|---|
| 2,253,558 | 8/1941 | Curtin | 26/28 |
| 3,523,346 | 8/1970 | Bolen et al. | 26/28 |
| 3,553,801 | 1/1971 | Hadley | 26/28 |
| 3,612,891 | 10/1971 | Ward | 26/28 |
| 4,480,362 | 11/1984 | Maxwell | 26/28 |

*Primary Examiner*—Clifford D. Crowder
*Assistant Examiner*—Amy Brooke Vanatta
*Attorney, Agent, or Firm*—Michael J. Striker

[57] ABSTRACT

In a process for continuous grinding of web-shaped, textile flat articles by a grinding tool with a coating angle determined by a coating roller, an adjusting member acts on the coating roller to adjust a coating angle in dependence on a friction force which acts on the flat article.

4 Claims, 3 Drawing Sheets

METHOD OF AND ARRANGEMENT FOR GRINDING OR POLISHING WEB-SHAPED TEXTILE STRUCTURES

BACKGROUND OF THE INVENTION

The present invention relates to a method of continuous grinding or polishing of web-shaped, textile flat structures.

Grinding or polishing is no longer considered as the best finishing process. In the clothing industry microfilament polyester yarns are used for the warp, and viscous filament or spinning fiber yarns are used for weft on increasing scale. These and other filaments must be polished. After polishing the finest fibrel fibers or microfibers produce new, sport impression. The textiles obtain a soft, flowing impression. It is identified as a "peach skin" effect. Also, during the manufacture of wild leather imitations these effects are desired.

The mechanical equipment for surface changes includes in practice two different types of machines, namely multi-roll polishing machines for polishing the outer surfaces and single roll machines for grinding the outer surfaces. In the multi-roll machines the products in tensioned condition are pulled through four to seven rollers coated with a polishing paper, and the rollers rotate in the running direction of the product or in the opposite direction. The product is brought in friction contact with the polishing surface with a more or less adjustable pressure. The polishing splits the projecting fibers and produces a velvet-like and at a same time very low fibrous pile. Depending on the grain size of the polishing tool, this effect is finer or coarser. Many articles are first polished on relatively coarse polishing rollers and then on fine polishing rollers.

In the microfiber fabrics there is however an opposite row succession. The multiroller machines used in praxis have decisive advantages as compared with the single roller machines, namely: yarn knots can deviate, and, with corresponding adjustment, they are not polished and opened. The polishing rollers are not heated. Therefore the standing time for the polishing paper is longer. The mechanical energy is distributed between the number of polishing locations and therefore reduced. With the use of the single roller machine it is possible to work with an exactly adjustable grinding depth. However, all thickness differences are ground-off. This means that the yarn knots are opened, and the covering selvage and product edges are ground-off and destroyed.

As mentioned hereinabove, the polishing effect is determined first of all by product tensioning, product pressure, polishing grain size and running direction of the polishing roller relative to the product. However, a proper evaluation of these effects is very difficult and their reproducibility is extremely complicated. For example, the condition of the polishing paper is a value which can distort the effects. Also, the faulty adjustments of the product tension can lead to substantial disadvantages. In practice the following approach is taken:

For first pattern adjustment, the individual rollers are decoupled or adjusted to perform free running. Then a user rotates with a finger the respective polishing roller is rotated and simultaneously increases the product wrapping around, or in other words the product coating angle. This is performed while the roller is rotated with forcible pressure. The process must be repeated for each charge since the polishing effect changes due to wear of the polishing device, and moreover even with two identical product qualities some differences can take place, for example, as a result of the expansion and moisture. The above described process is expensive and not economical due to the long stoppage time.

Excessive wrapping increases the removal of the fiber material and reduces the shearing strength. For this process the experience of the grinding machine operator is required. He must select the adjustment in view of the relation between the product tension on the one hand and the wrapping of the polishing roller (product coating angle) on the other hand so as to obtain the best effect with the maximum shearing strength. For this purpose in order to perform the adjustment the machine operator must analyze the value of the amperemeter on the motor of the polishing roller and the scale value of the guiding roller (product coating angle). As a rule, he adjusts up a pattern recorder. Before and after each grinding passage, a pattern is removed and stored. Therefore, the machine operator must again examine the shearing strength and the product efficiency.

The effect evaluation in many cases is based on observations which, however, have reduced accuracy when the above mentioned disturbances negatively affect the results of the polishing process. The grip of the polishing paper, its wear, the reaction of the product to the adjusted tension, the danger of a fold formation in the longitudinal direction, the expansion conditions of the product, as well as different moisture values and possible electrostatic charges can unfavorably affect the results.

SUMMARY OF THE INVENTION

Accordingly, it is an object of the present invention to provide a method of and an arrangement for grinding or polishing web-shaped textile flat articles, with which the friction condition between the flat article to be ground and the grinding tool are maintained constant and independent of the type the tension value, the tension of the surface structure and the condition of the grinding tool.

In keeping with these objects and with others which will become apparent hereinafter, one feature of the present invention resides, briefly stated, in a process of continuous grinding of web-shaped textile surface structures, in accordance with which a coating roller is connected with an adjusting member which continuously changes the coating angle in dependence on the friction force which acts on the flat article.

When the method is performed in accordance with the present invention, it eliminates the disadvantages of the prior art and attains the objects specified hereinabove.

In accordance with another feature of the present invention the flat structure is in contact with one or several grinding tools at different locations.

It is a further feature of the present invention to provide an arrangement for performing the method, in which an adjusting member and a grinding roll are connected to a regulator which is adjusted to a nominal value determined by the type of flat article, and in the event of a difference between a nominal value and an actual value of the grinding roll the regulator actuates the adjusting member for increasing or reducing the coating angle.

The friction moment which is required for the optimal grinding effect on the respective grinding roll is determined via a signal of the current value (the nominal value). With this nominal value, a motor post-regulation of the coating angle is performed until the nominal value signal coincides with the current of the motor of the grinding roll (the actual value). When the polishing coating is substantially worn out, a greater friction surface is required than for new grains, for obtaining the same friction moment. When the maximum permissible coating angle is exceeded, simultaneously an acoustic or optical signal can be produced to indicate the wear value and the need to provide a new polishing coating of the grinding roll. Simultaneously with the determination of the friction moment from the current consumption, the pressing force (normal force) caused by the tangential product tension can be determined and integrated in measurement results, which can be clearly recognized from the observation of purely physical process flow.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
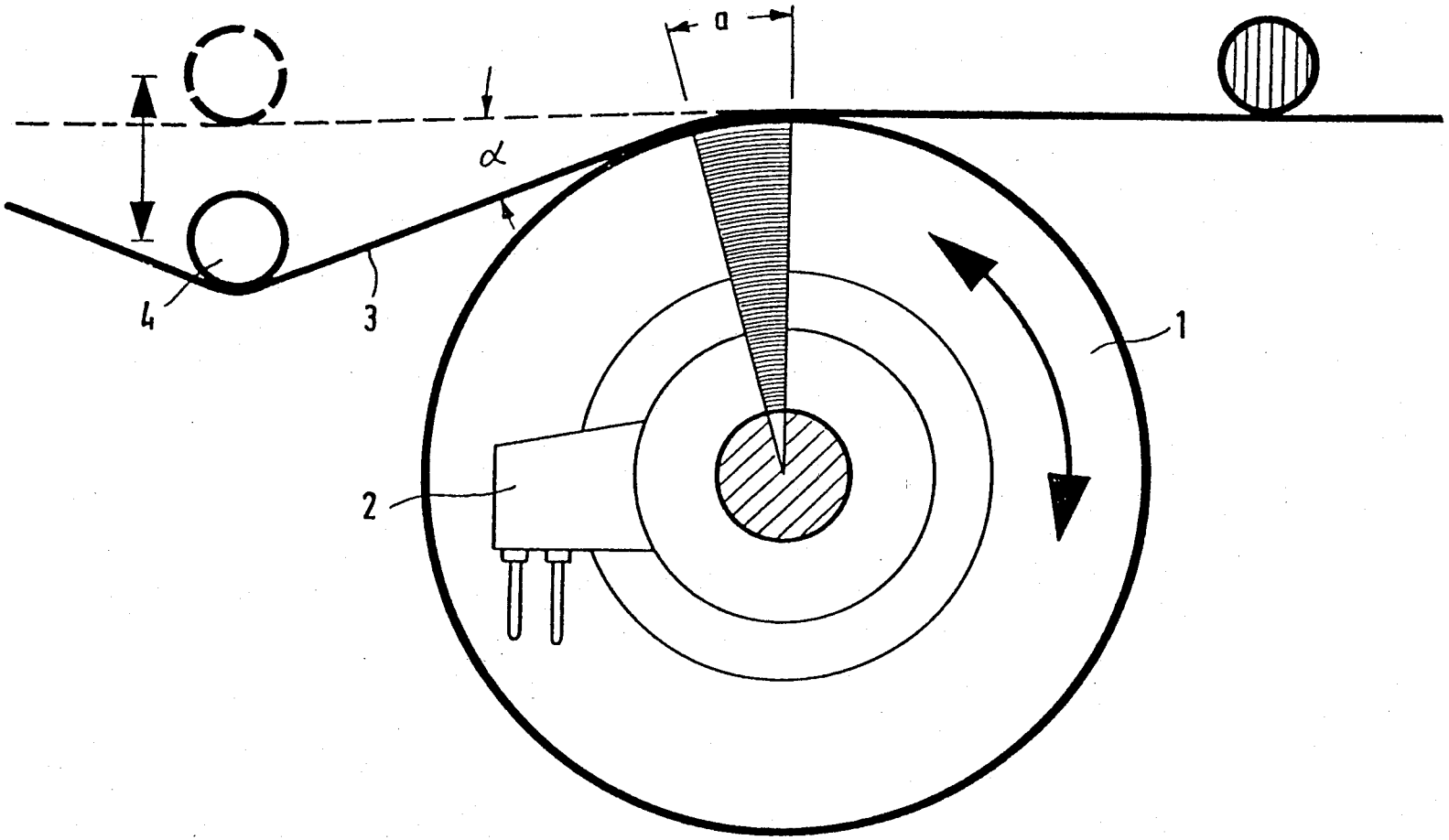
FIG. 1 is a view showing a motor-driven grinding roll and a flat article in contact with the grinding roll, of an arrangement in accordance with the present invention.

FIG. 1 shows a grinding tool which is identified with reference numeral 1 and formed as a grinding roll. A grinding paper coating is applied to the peripheral surface of the grinding roll. The grinding tool 1 is driven in rotation by an electric drive motor 2.

A web-shaped, textile flat article is identified with reference numeral 3. It is arranged under a predetermined tension and is in contact with a region a of the grinding roll 1. The region a is determined by a coating roller 4. The peripheral speed of the grinding roll 1 is variably greater than the displacement speed of the flat article 3. Due to the relative movement between the grinding roll 1 on the one hand and the flat article 3 on the other hand, the flat article is correspondingly ground so that a so-called "peach skin" effect is produced.

The electric drive motor 2 is connected with a current source 5 through corresponding conductors. It is also in connection with an electric regulator 6 which is connected with a motor-driven adjusting member 7 through conductors. The adjusting member 7 has a screw spindle 8. A rod 9 is freely rotatable in the spindle 8 and is non-displaceable in the axial direction. The free end of the rod 9 carries the coating roller 4.

Figure 2:
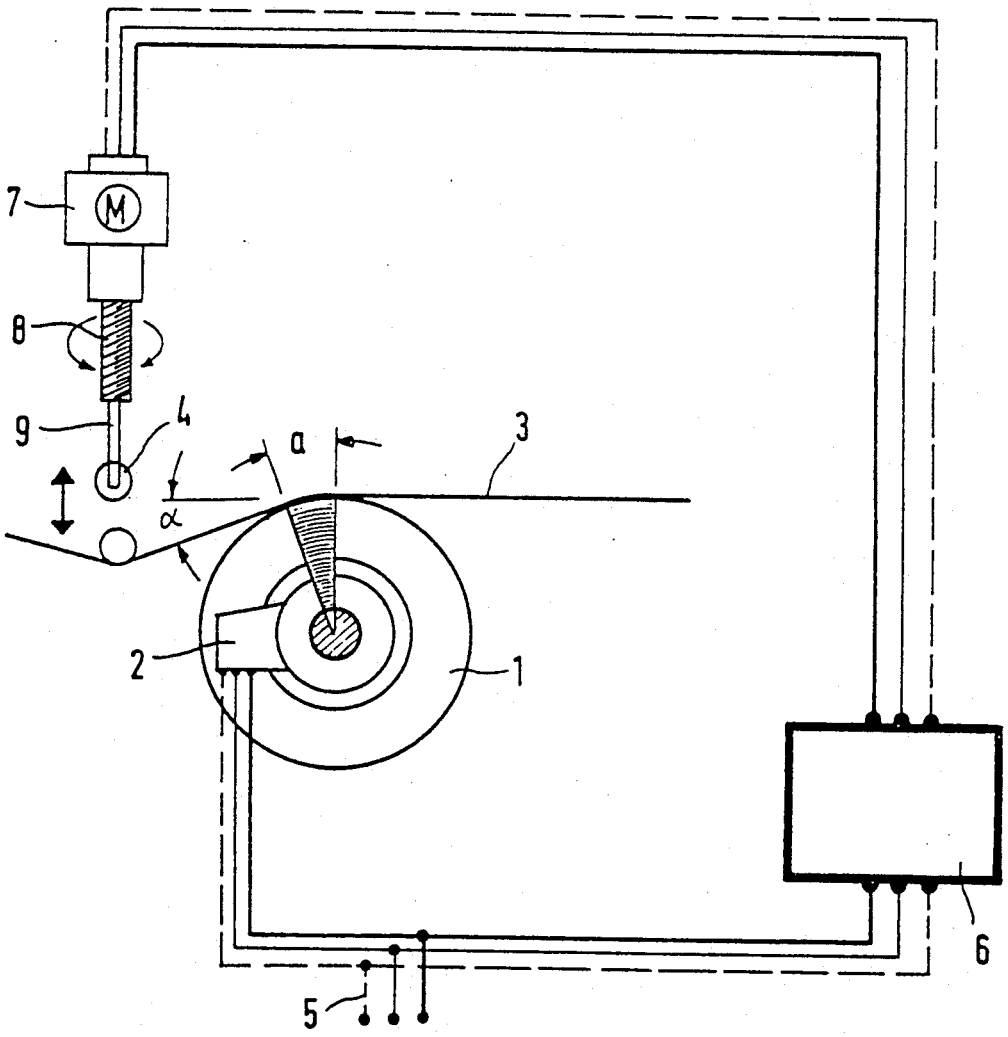
FIG. 2 is a view schematically showing the inventive arrangement.

The regulator 6 is adjusted to an empirically determined nominal value which is dependent on the type of the flat article 3. During the operation the normal value can be, for example, exceeded because the wear of the grinding layer on the grinding roller 1 reduced the friction force between the flat article 3 and the grinding roll 1. Then the regulator 6 controls the adjusting member 7 as a result of the difference between the nominal value and the actual value due to the reducing friction moment acting on the grinding roll 1. In this particular case the regulator displaces the coating roller 4 in FIG. 2 downwardly via the screw spindle 8. As a result, the coating angle and therefore the contact region a is increased. As can be seen from the drawings, the coating angle $\alpha$ is an angle between the article 3 and a line extending perpendicular to the radial line of the grinding roll 1 in the point of contact of the article 3 with the grinding roll. The coating angle can be defined as an angle of wrapping of the article around the grinding roll. Thereby the friction moment which acts on the grinding roll 1 is increased and the actual value approaches the nominal value. When the difference between both values becomes zero, the equilibrium condition is achieved and no change in the coating angle takes place.

To the contrary, in the case of an increase in the friction moment, for example, as a result of an increase of the tensioning of the flat article 3, the difference between the nominal value and the actual value is reduced by controlling the adjusting member 7 with the regulator 6. The coating angle is reduced until the equilibrium condition is obtained.

The regulator 6 of the above described type is a commercially available device, and therefore further details of its construction and operation are dispensed with.

Figure 3:
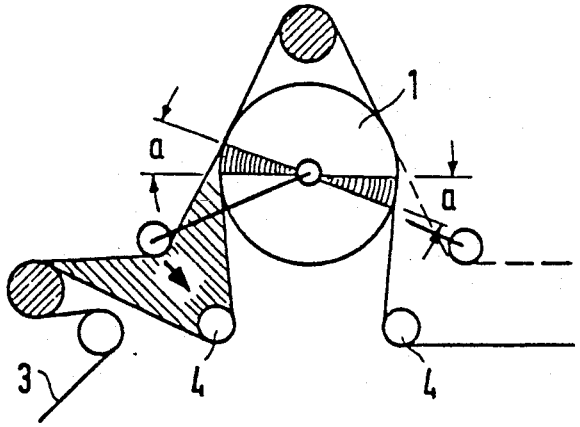
FIGS. 3–6 are views showing one or several grinding rolls with associated coating rollers of the inventive arrangement.

FIG. 3 shows a four roll grinding arrangement with the corresponding grinding roll 1 and the coating roller 4.

Figure 4:
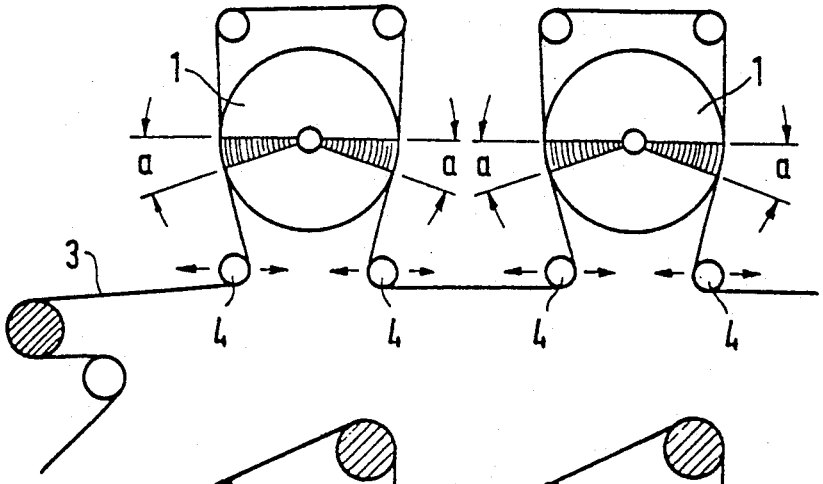

In the embodiment shown in FIG. 4, the flat article 3 is in contact with the same grinding roll 1 at several locations namely at two locations a.

Figure 5:
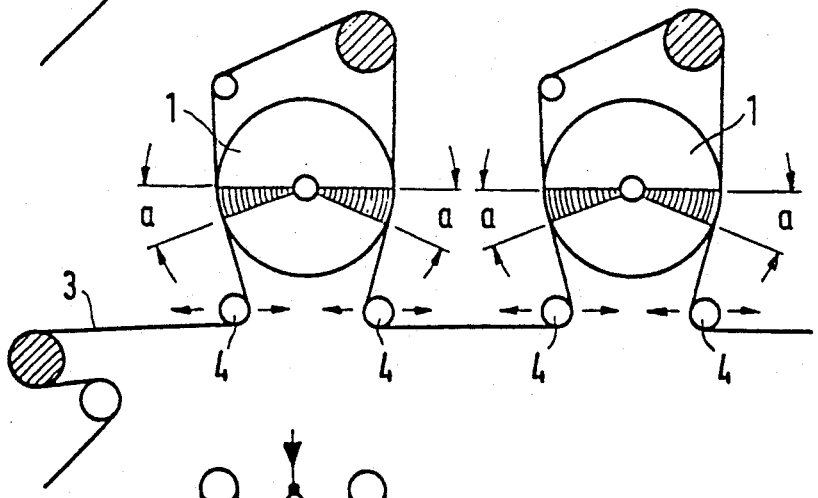

In contrast, in the embodiment of FIG. 5 a two-roll grinding arrangement has two contact locations per each grinding roll 1.

Figure 6:
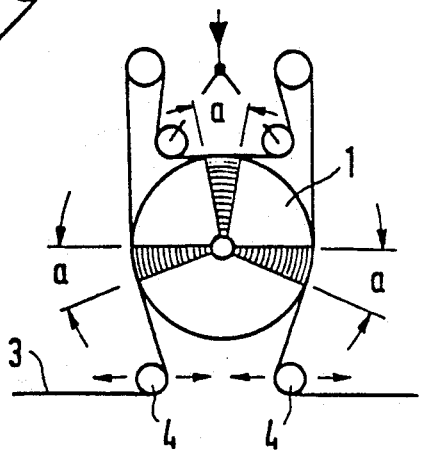

FIG. 5 shows a comparable embodiment, while FIG. 6 shows three contact locations a per each grinding roll.

It will be understood that each of the elements described above, or two or more together, may also find a useful application in other types of methods and constructions differing from the types described above.

While the invention has been illustrated and described as embodied in a method and arrangement for continuous grinding of web-shaped textile flat articles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A method of continuously grinding web-shaped, textile flat articles, comprising the steps of bringing a flat article with a longitudinal tension in contact with at least one grinding tool; providing a roller which acts on the flat article so as to determine an angle of coating of the grinding tool by the flat article; connecting the roller with an adjusting member which can displace the roller so as to change the action of the roller on the article and therefore to change the angle of coating; continuously determining by a regulator an actual value of a friction force acting on the flat article during grinding in the event of the deviation of the actual value of the friction from a nominal value of the friction force acting on the adjusting member; and displacing the flat article by means of the adjusting member acting on the coating roller in response to the regulator so as to automatically change the angle of coating so as to eliminate the deviation.

2. A method as defined in claim 1, wherein the grinding tool is a grinding roller covered with a grinding substance.

3. A method as defined in claim 1, wherein said bringing includes bringing said article in contact with said grinding tool at several locations on said grinding tool.

4. An arrangement for continuously grinding web-shaped textile flat articles, comprising at least one grinding tool with which a flat article under tension is brought in contact; a roller adapted to displace a flat article so as to change an angle of coating of the grinding tool by the flat article; an adjusting member connected with said roller so as to displace said roller; and a regulator connected with said adjusting member for continuously monitoring an actual value of a friction force acting on the flat article during grinding and in the event of a deviation of the actual value of the friction force from a nominal value of the friction force for controlling said adjusting member so that said adjusting member acts on said roller and said roller displaces the flat article so as to automatically change the angle of coating to eliminate the deviation.

* * * * *